United States Patent [19]

Vadasz Fekete

[11] Patent Number: 4,591,315

[45] Date of Patent: May 27, 1986

[54] PISTON WITH COMPOSITE RETENTION VALVE

[76] Inventor: Amnon M. Vadasz Fekete, Av.Principal de Sebucan, Resid.Jardines de Sebucan, Apto.7-D. Urb., Sebucan, Caracas, Venezuela

[21] Appl. No.: 427,157

[22] Filed: Sep. 29, 1982

[51] Int. Cl.[4] ..... F04B 3/00; F04B 7/00

[52] U.S. Cl. ..... 417/259; 417/513; 417/514; 417/520

[58] Field of Search ..... 417/486–488, 417/259, 511–514, 520

[56] References Cited

U.S. PATENT DOCUMENTS

| | | | |
|---|---|---|---|
| 573,860 | 12/1896 | Chapman | 417/512 |
| 706,861 | 8/1902 | Sehe | 417/512 |
| 1,221,843 | 4/1917 | Dierks | 417/511 |
| 1,538,855 | 5/1925 | Jackson | 417/511 |
| 2,775,212 | 12/1956 | Hilton | 417/511 |
| 2,791,970 | 5/1957 | Hunter | 417/513 |
| 2,933,050 | 4/1960 | Crowl et al. | 417/517 |
| 3,109,384 | 11/1963 | Adams | 417/511 |
| 4,332,533 | 1/1982 | Spears | 417/513 |

*Primary Examiner*—William L. Freeh

*Attorney, Agent, or Firm*—Baker & McKenzie

[57] ABSTRACT

A positive displacement pump particularly useful in pumping viscous fluids which may or may not contain gases, including water vapor, and/or suspended solids in which the actual flow equals the theoretical maximum flow through a check valve associated with the pump, said pump including a piston having a plug valve incorporated therein which has limited reciprocable movement within an extension of the piston, and, also, within a cage which is reciprocable within said extension, the flow area within the piston downstream from the plug being at least equal to the flow area past the plug.

4 Claims, 1 Drawing Figure

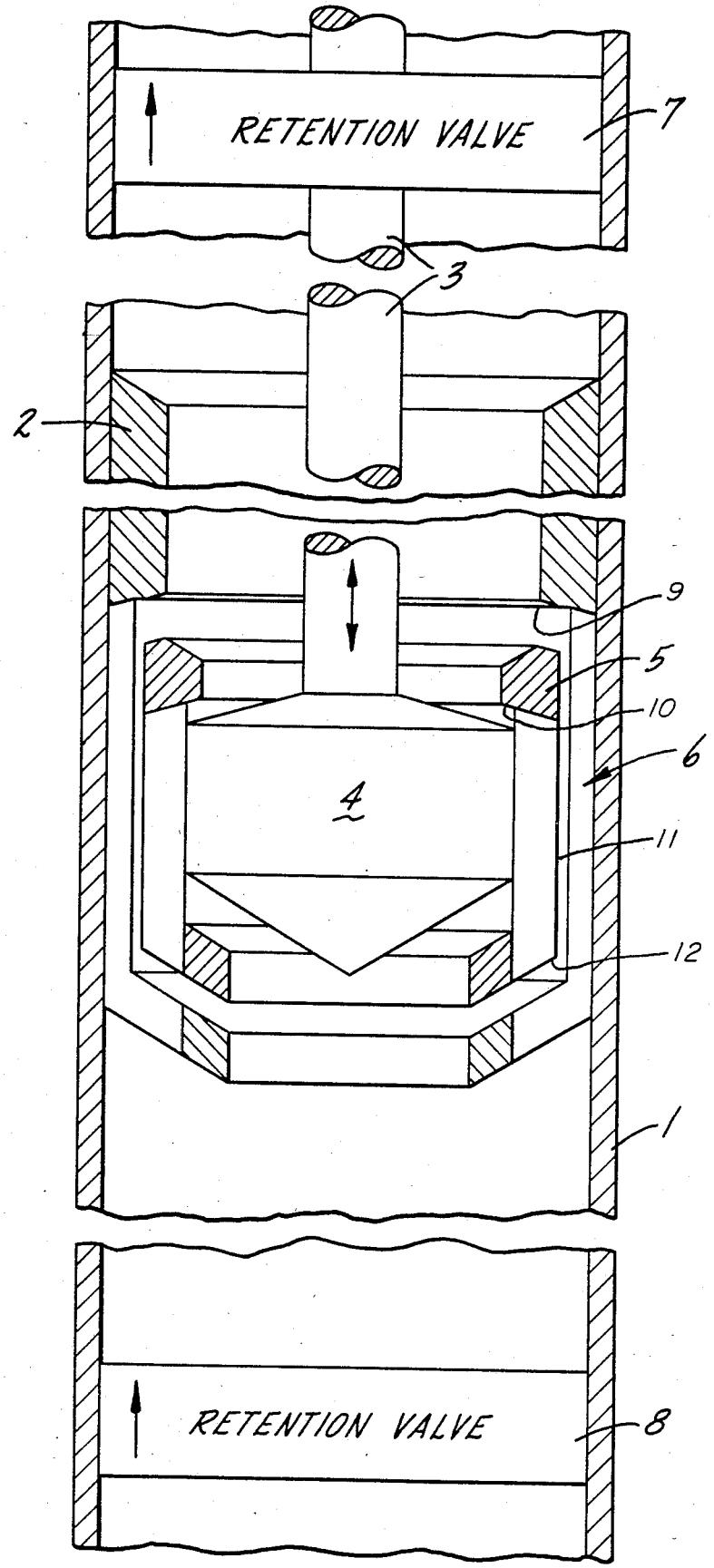
RETENTION VALVE
7
3
2
9
5
10
6
4
11
12
1
RETENTION VALVE
8

PISTON WITH COMPOSITE RETENTION VALVE

SUMMARY OF THE INVENTION

The objective of the present invention is to resolve the limitations of the pistons present in pumps (or compressors) using the principle of positive displacement, in order to provide for a pump (or compressor) with optimal pressure ratio and to maximize the area of possible flow through a composite retention valve secured to the piston.

The piston which meets the objectives of the present invention is constituted by a cylindrical body which is displaced within another cylinder, a stem which transmits a periodic movement to a plug which can contact a ring (or several rings) via a seat, which in turn can come in contact with the cylindrical body through another seat, in one direction, and, through any other method which may transmit the movement of the stem to the cylindrical body in the other direction.

The same piston of this invention, together with a retention or check valve secured to the cylinder, within which the piston is displaced, will constitute a pump which may be used for pumping very viscous fluids with or without contents of suspended solids. If another retention or check valve is secured in the cylinder within which the piston is displaced, so that the piston is displaced between the two check valves, then the pump (or compressor) also will be able to pump fluids with a high contents of dissolved gases and/or water vapor.

For a better understanding of this invention, a possible embodiment of same and its operation will be described when same will form part of a pump (or compressor), with the understanding that this presentation is merely for explanatory purposes and is in no way limitative.

BRIEF DESCRIPTION OF THE DRAWING

FIG. 1 is a diagram of the component parts of the present invention.

DETAILED DESCRIPTION OF THE INVENTION

FIG. 1 represents a possible design of the piston, which is the subject of this invention. The piston is displaced inside a fluid flaw conduit or cylinder 1 and formed by a cylindrical body 2, a stem 3, a plug 4, and a ring 5. The plug 4, the ring 5 and the place 9 in the cylindrical body 2 where the ring 5 is seated, constitute the traveling retainer valve 6; the traveling retainer valve 6 may also hereinafter sometimes be referred to as the plunger 6.

Since the traveling valve 6 is located in the suction end of the piston, the pressure ratio in the pump is optimal.

The free spaces between the stem 3 and the interior of the cylindrical body 2 is the only factor which limits the flow area through the piston that is, the area of the inside diameter of the cylindrical body 2 minus the area of the stem, or plunger reciprocating means, 3 is the theoretical maximum flow area through the plunger. As is apparent from the Figure, said area may be described as a generally uninterrupted annular flow area. It is thus possible to optimize the flow area through the plunger 6, by so between the plug 4, the ring 5 and the cylinder 1 is equal to the flow area between the stem 3 and the interior of the cylindrical body 2; that is, said space, which is the inside area of cylinder 1 minus the area of, firstly, plug 4 and, secondly, ring 5, when equal to the area of the inside of the cylindrical body 2 minus the area of stem 3, will provide the optimal, or maximum flow through the plunger.

The operation of the piston, the subject of the invention, is hereinafter described when it is applied to pumps in which the stem is moved in a vertical direction, like in the underground pumps used in the petroleum industry. The explanation of the operation is valid for all pumps (or compressors) using the principle of positive displacement. If the stem is moved in a direction in a direction other than vertical, then only the gravitational components which actuate in the vertical direction need to be considered.

During the operation of the pump, when the stem 3 commences to descend from the extreme upper position, the annular retention valve 7 (secured to the cylinder 1 on the discharge side of the piston), which is used optionally when there is a high content of gases and/or water vapor dissolved in the fluid, is closed starting to support the counterpressure effects and the effects of the weight of the fluid column located above the valve 7; meanwhile, the piston descends by the mechanical action of the stem 3, aided by the action of the weight of the reduced fluid cloumn located between the traveling valve 6 and the annular valve 7 or by the entire fluid column when the annular valve 7 is not used, until the increase of the pressure between the traveling retention valve 6 and the fixed valve 8 (secured to the cylinder 1 on the suction side of the piston) and primarily the friction between the cylindrical body 2 and the cylinder 1 detain the movement of said cylindrical body 2. When the latter is detained, the plug 4, which is secured to the stem 3, is separated from its seat 10 in the ring 5. Once this occurs, the ring 5 is separated from its seat a in the cylindrical body 2 by effects of gravity and/or by any other means which transmits to it the descending movement of the stem 3. Finally, this descending movement is transmitted to the piston via the cylindrical body 2 through the plug 4, the extension 11 of ring 5 and the extension 12 of cylindrical body 2, or any other means. The opening of the traveling valve 6 is forced, and not due to the difference of pressures. Therefore, the fluids which may be present within the cylinder 1 between the traveling valve 6 and the fixed valve 8 do not have to be compressed. As the piston descends said fluids flow through the traveling valve 6 and the cylindrical body 2.

Once the piston reaches its extreme lower position and the stem 3 starts to rise, the plug 4 makes contact with seat 10 in the ring 5 and now both rise, closing the traveling valve 6 as soon as the ring 5 makes contact with seat traveling valve of the cylindrical body 2. Once the traveling valve 6 closes, the ascending movement is transmitted to the piston; all this occurs when the relative speed of the fluid at both sides of the piston is zero. As said piston rises, a drop of pressure is going to be created inside the cylinder 1 between the traveling valve 6 and the stationary valve 8 until this pressure is less than the tank's own pressure (any container or location where fluids are located). This time, this latter valve 8 will open, allowing the flow of the fluids from the tank to the interior of the cylinder 1. Meanwhile, if an annular valve 7 is used, as when the contents of gas and/or water vapor in the fluid so merits it, the fluid present inside the cylinder between the traveling vavle 6 and the annular valve 7 is going to be compressed until the pressure in that area will be higher than the counter-pressure effects and higher than the weight of the fluid column which acts on the annular valve 7, in which case the valve opens and allows for the outflow of the fluid.

Finally, when the piston reaches the extreme upper position and commences to descend, the fixed valve 8 closes and the pumping cycle is repeated.

The advantages of the present invention are:

1. Prior to the start of the suction cycle of the piston, the stem 3, causes movement of the plug 4 and consequently to the ring 5, both of which are displaced as far as the seat 9 of the ring ring 5 in the cylindrical body 2, and they start to close the opening of the retention valve. All this takes place when the relative velocity of the fluid is zero on both sides of the retention valve; therefore, the erosion effects of the fluid upon the components of the piston are practically eliminated.

2. Since the traveling retention valve, located in the piston, closes prior to the start the suction stroke of the pumped volume is practically the maximum volume.

3. If the pumped fluid contains a high content of gases and/or water vapor, the fact that the traveling retention valve opens in a forced manner (mechanically), and not by difference in pressures, eliminates in only one piston stroke the possible condition of blocking by gases and/or water vapor.

4. If the pump is installed so that the stem is moved in a direction other than horizontal, the possibility exists that solids suspended in the fluid may be deposited on the traveling retention valve. The position of the plug 4 in the piston is such that the flow of fluid can relieve said valve.

5. The plug 4 and the ring 5 may be designed in such a manner that the traveling valve presents the maximum area of flow which is permitted with a composite retention plug and thus offers optimal characteristics with respect to the dynamic of the fluids.

Having described the above invention as it has been done, it is claimed:

1. A positive displacement composite retention valve pump apparatus having a piston in which the actual flow equals the theretical maximum flow through a composite traveling retention valve carried by the piston, said apparatus including, in combination, a confined fluid flow conduit, a piston adapted for reciprocal movement within the fluid flow conduit between upstream and downstream limit positions, piston reciprocating means, and pressure responsive check valve means located upstream with respect to the piston in the fluid flow conduit, said pressure responsive check valve means being operable to permit fluid flow therethrough in a downstream direction toward the piston, and to preclude fluid flow therethrough in an opposite direction, said piston being composed of a plurality of parts which are relatively movable with respect to one another prior to movement of the entire piston in a direction to positively displace fluid therein, said piston including a composite traveling valve consisting of a plug, a cylinder reciprocable within the confined fluid flow conduit, and a ring located between the cylinder and the plug, said ring being arranged to make sealing engagement with the cylinder at a first seal location and to make sealing engagement with the plug at a second seal location, said position reciprocating means being operatively connected to the plug, said composite traveling valve being arranged to close by the application of an external force to the piston reciprocating means and thereby the plug prior to suction movement of the cylinder, the plug, ring and cylinder being so proportioned that the flow area between the plug and the ring, and the flow area between the ring and the cylinder is equal to the flow area between the cylinder and the piston reciprocating means whereby the maximum flow area through the traveling valve is provided.

2. The positive displacement composite retention valve pump apparatus of claim 1 further characterized by and including a second pressure responsive check valve means located downstream with respect to the plunger in the fluid flow conduit, said second pressure responsive check valve means being operable to permit fluid flow therethrough in a downstream direction away from the plunger, and to preclude fluid flow therethrough in an opposite direction.

3. The positive displacement composite retention valve pump apparatus of claim 1 further characterized, firstly, in that the ring includes an extension integral therewith with which the plug makes contact so as to move the ring in an upstream compression direction after said ring unseats from said cylinder, and, secondly, in that the cylinder includes an extension integral therewith which is adapted to be operatively engaged by the plug so as to move the cylinder in an upstream compression direction after said plug unseats from said ring.

4. The positive displacement composite retention valve pump apparatus of claim 3 further characterized by and including a second pressure responsive check valve means located downstream with respect to the plunger in the fluid flow conduit, said second pressure responsive check valve means being operable to permit fluid flow therethrough in a downstream direction away from the plunger, and to preclude fluid flow therethrough in an opposite direction.

* * * * *